US009894966B2

(12) United States Patent
Meyer-Steffens et al.

(10) Patent No.: US 9,894,966 B2
(45) Date of Patent: Feb. 20, 2018

(54) COIN AND METHOD FOR TESTING THE COIN

(71) Applicant: Crane Payment Innovations, Inc., Malvern, PA (US)

(72) Inventors: Klaus Meyer-Steffens, Deinste (DE); Hans-Ulrich Cohrs, Horneburg (DE); Wilfried Meyer, Buxtehude (DE)

(73) Assignee: Crane Payment Innovations, Inc., Malvern, PA (US)

( * ) Notice: Subject to any disclaimer, the term of this patent is extended or adjusted under 35 U.S.C. 154(b) by 335 days.

(21) Appl. No.: 14/418,772

(22) PCT Filed: Jul. 26, 2013

(86) PCT No.: PCT/EP2013/065831
§ 371 (c)(1),
(2) Date: Jan. 30, 2015

(87) PCT Pub. No.: WO2014/019961
PCT Pub. Date: Feb. 6, 2014

(65) Prior Publication Data

US 2015/0201721 A1 Jul. 23, 2015

(30) Foreign Application Priority Data

Jul. 30, 2012 (DE) ..... 10 2012 014 958

(51) Int. Cl.
*A44C 21/00* (2006.01)
*G07D 5/00* (2006.01)
*G07D 5/02* (2006.01)

(52) U.S. Cl.
CPC ..... *A44C 21/00* (2013.01); *G07D 5/00* (2013.01); *G07D 5/02* (2013.01); *Y10T 428/21* (2015.01)

(58) Field of Classification Search
None
See application file for complete search history.

(56) References Cited

U.S. PATENT DOCUMENTS 3,188,471 A * 6/1965 Hansen ..... G01N 23/20083 250/308
3,983,646 A 10/1976 Howard
(Continued)

FOREIGN PATENT DOCUMENTS

CH 693 973 A5 5/2004
CN 1120709 A 4/1996
(Continued)

OTHER PUBLICATIONS

Thomas et al, DE 10 2010 013 148 A1, Pub. Date Sep. 29, 2011.*
(Continued)

*Primary Examiner* — Tri Ton
*Assistant Examiner* — Jarreas C Underwood

(57) ABSTRACT

A coin comprises a core made of a first metal, an outer ring surrounding the core concentrically and made of a further metal, and a central ring between the core and outer ring fixedly connected thereto. The central ring consists of an electrically insulating material. Further, the central ring is transparent to electromagnetic waves of a first wavelength range and is less transparent or not transparent to a second wavelength range. Methods for testing the coin are also described.

13 Claims, 4 Drawing Sheets

(56) References Cited

U.S. PATENT DOCUMENTS 4,435,911 A * 3/1984 Jones ..... A44C 21/00 40/27.5
4,894,551 A * 1/1990 Kishimoto ..... G01B 11/245 250/559.23
5,392,892 A * 2/1995 Mulder ..... G07D 5/02 194/334
5,477,332 A * 12/1995 Stone ..... G01B 11/255 348/128
5,494,147 A * 2/1996 Takahashi ..... G07D 5/005 194/328
5,538,123 A * 7/1996 Tsuji ..... G07D 5/005 194/303
5,754,294 A * 5/1998 Jones ..... G01B 11/06 356/432
5,996,262 A * 12/1999 Kim ..... A44C 21/00 40/27.5
6,021,882 A * 2/2000 Juds ..... G07D 5/00 194/212
6,053,300 A * 4/2000 Wood ..... G07D 5/08 194/317
6,305,523 B1 * 10/2001 House ..... G07D 5/005 194/317
6,417,471 B1 * 7/2002 Rompel ..... G07D 5/005 194/328
6,490,534 B1 * 12/2002 Pfister ..... A41H 1/00 382/173
6,722,487 B1 * 4/2004 Bell ..... G07D 5/08 194/302
6,851,541 B1 * 2/2005 Howells ..... G07D 5/08 194/317
6,871,788 B2 * 3/2005 Tompkin ..... A44C 21/00 235/454
7,004,299 B2 * 2/2006 Eich ..... G07D 5/005 194/328
7,243,772 B2 * 7/2007 Harris ..... G07D 5/08 194/302
7,886,977 B2 * 2/2011 Wichers ..... G06K 7/10732 235/454
7,916,281 B2 * 3/2011 Haddock ..... G07D 5/10 194/302
9,378,604 B1 * 6/2016 Rathjen ..... G07D 3/14
9,558,544 B2 * 1/2017 Truong ..... G07D 5/005
2006/0032726 A1 * 2/2006 Vook ..... G07D 5/005 194/328
2012/0118698 A1 * 5/2012 Anouar ..... G07D 7/121 194/328

FOREIGN PATENT DOCUMENTS

| | | | |
|---|---|---|---|
| CN | 1191030 | A | 8/1998 |
| CN | 1289429 | A | 3/2001 |
| DE | 27 24 868 | A1 | 12/1978 |
| DE | 10 2009 020 487 | A1 | 11/2010 |
| DE | 10 2010 013 148 | A1 | 9/2011 |
| EP | 0 694 888 | A1 | 1/1996 |
| EP | 1 136 958 | A1 | 9/2001 |
| GB | 2 375 215 | A | 11/2002 |
| JP | 5217055 | | 8/1993 |

OTHER PUBLICATIONS

Office Action dated Sep. 6, 2016 in connection with Korean Application No. 10-2015-7005003, 14 pages.
Notification of First Office Action dated Sep. 29, 2015 in connection with Chinese Patent Application No. 201380046938.0; 20 pages.

* cited by examiner

COIN AND METHOD FOR TESTING THE COIN

TECHNICAL FIELD

The invention relates to a coin and a method for testing the coin.

BACKGROUND

For many years, so-called bicolour coins have been in use around the world that consist of an inner core and an outer ring surrounding the core. The core and outer ring are produced from different metal materials. It is also disclosed in DE 10 2010 013 148 to add to the coin an additional material component in the form of a central ring. The central ring which is produced, for example, from a polymer or a composite material is connected in an electrically insulating and fixed manner to the outer ring and core.

The testing of bimetal coins takes place primarily by electromagnetic measuring methods. It has been shown that due to corrosion, for example, the transition resistance between the core and the outer ring leads to errors in the measurement results. The effect of these errors is all the greater the higher the differences in potential of the metals or alloys used.

It is further disclosed in DE 10 2010 013 148 that the central ring is intended to consist of a transparent, semi-transparent, opalescent material and/or a material producing a colour effect. The width of the central ring is preferably between 0.5 mm and 3 mm.

In addition to improving the ability to test said coins by electromagnetic means, an improved capacity for differentiation relative to other conventional coins is also achieved. The user may identify, for example, a transparent central ring simply by observation.

SUMMARY

According to the teachings herein, a coin results that may be easily detected by means of optical arrangements. The methods described herein allow coins comprising a central ring to be detected in a simple and effective manner.

The coin has a central ring that is transparent to electromagnetic waves of a first wavelength range and/or is less transparent or not transparent to a second wavelength range.

If such a coin passes through a light barrier, for example, when the central ring is made of transparent material, the number of light barrier signals or even the number of light barrier interruptions may be counted. At the same time, the individual times when the light beam is interrupted, or respectively the light beam passes through, may be recorded in the form of changes to the signal or durations of the signal. From the resulting signal sequence, the presence of the transparent or translucent ring may be detected and from the detected times, the individual widths of the outer ring, of the translucent central ring and the metal core may be determined.

According to an embodiment of the invention, the material of the central ring is translucent to the visible wavelength range. According to a further embodiment of the invention, the material of the central ring is translucent to the invisible wavelength range. According to a further embodiment of the invention, the material of the central ring is translucent to the visible and invisible wavelength ranges and not transparent to a wavelength range or to specific wavelength ranges of visible or invisible light, in particular the infrared range. The last embodiment of the invention is particularly preferred. This is due to the fact that in coin test devices, detection light barriers normally operate using infrared light. If the central ring consists of a material which is translucent but which is not transparent to infrared light, then the sensor arrangement, which is sensitive both to infrared light and to visible light, reacts differently if a coin moves through the optical arrangement and light is passed through the sensor arrangement without an obstruction or with an obstruction. On the other hand, it is also within the scope of the invention to provide that the material for the central ring is not transparent to a visible wavelength range, for example to the red range.

According to a further embodiment of the invention, the material of the central ring is translucent to the visible wavelength range and not transparent to at least one specific wave range of visible light. A further embodiment of the invention provides that the material of the central ring is translucent to the invisible wavelength range and transparent to at least one specific wavelength range of visible light.

All disclosed possibilities for the transparency or non-transparency of electromagnetic waves in the visible or the invisible range, permit simple methods for discriminating coins provided with a central ring made of an electrically insulating material that is transparent to at least one limited spectral range of the light.

According to a further embodiment of the invention, the central ring has a different reflection factor from the core or the outer ring. The reflective nature of the coin surfaces may also be detected by means of an optical arrangement to determine if the reflection factor of the central ring is different from that of the outer ring, or respectively the core. Thus, for example, the central ring may be more reflective than the core or the outer ring. Moreover, additional optically detectable properties of the central ring may be detected by means of a suitable optical arrangement, for example colour pigments, ultraviolet (UV) stabilizers, fluorescent or holographic particles, etc.

A method for testing a coin comprising a central ring made of electrically insulating material is based on an optical arrangement through which the coins move and at the same time produce a signal that is evaluated in an evaluation device for producing a genuine coin signal or counterfeit coin signal. According to the method, light is passed through the coins from at least one optical transmitter and an optical arrangement receives the light reflected by the central ring and/or the light passing therethrough, and an evaluation device produces a signal when the coins are moved through the sensor arrangement. If the material of the central ring is transparent, for example, light in the visible wavelength range is passed through the central ring and is able to strike the sensor arrangement and produce a corresponding signal. If the central ring is transparent to light in the invisible wave range and the sensor arrangement is sensitive to this light, a signal may also be produced if invisible light of the light source or the optical sensor passes through the material of the central ring and strikes the sensor arrangement. Thus, for example, a light barrier located transversely to the direction of travel of the coin may be provided and the evaluation device counts the number of changes to the signal when the coin passes through the light barrier. At the same time, the individual times when the light beam is interrupted, or respectively the light beam passes through, are recorded via the duration of the signal.

According to an embodiment of the invention, the evaluation device analyses the signal of the sensor arrangement and produces a genuine coin signal if the spectrum of the received light corresponds to the material of the central ring of a genuine coin. If, for example, white light is produced by the optical sensor, by means of a spectral analysis it may be established by the sensor arrangement whether the spectrum of the light passed therethrough corresponds to that which is generally produced by the material of the central ring of a genuine coin. It is possible to determine from the analysis whether the light of the optical transmitter has an invisible component or not, in order to test for example whether the material of the central ring is not transparent to invisible light.

When electromagnetic waves or light are discussed above and below, this is broadly understood as light in the visible and invisible spectrum, provided it is able to be processed by conventional elements and devices available at the time without safety precautions.

According to an embodiment of the invention, the sensor arrangement is sensitive to at least one defined wavelength range. According to a further embodiment of the invention, the sensor arrangement is sensitive to a wavelength range of visible light. Alternatively, the sensor arrangement may be sensitive to a wavelength range of invisible light. According to a further embodiment of the invention, the sensor arrangement is sensitive to a wavelength range of visible light and a wavelength range of invisible light.

It is also possible, instead of assuming the selective sensitivity of the sensor arrangement itself, to arrange one or more filters upstream thereof that allow through, or respectively block, specific wavelength ranges of the light of the optical transmitter.

The sensor arrangement contains at least one sensor element, for example in the form of a phototransistor. According to an embodiment of the invention, two or more sensors may also be provided. Instead of providing sensors with a narrow field of view, it is conceivable to use a surface sensor or line sensor according to an embodiment of the invention. To this end, for example, on one side of the coin channel a light source is used which transmits light of the transparent and blocked wavelength range, for example white light. On the opposing side a light sensitive surface sensor or line sensor is located. Said sensor is preferably as least as wide as the width of the central ring of the coin. Generally, this ring width is 1.0 mm to 1.5 mm. The light-sensitive sensor arrangement is designed so that it detects the two wavelength ranges, namely that of the transparent light and also that of the blocked wavelength range. In the resting state, the sensor arrangement detects both visible and invisible wavelength ranges as no object is located between the transmitter and receiver. However, if the coin rolls with the central ring past the sensor arrangement, initially all wavelengths are blocked by the metal outer ring. If the specific material of the central ring passes the sensor arrangement, only the blocked wavelength range is absorbed, for example the infrared range, and not the other wavelengths. This is therefore a feature which is able to be evaluated and which serves for testing or discriminating the coins. In the disclosed process, if the core now moves past the sensor arrangement, once again all wavelengths are blocked. Subsequently at a second location, the central ring passes the sensor arrangement and finally the second side of the metal outer ring.

By means of the disclosed light-sensitive sensor arrangement, the entire irradiated surface may be determined in terms of size as well as the width of the individual components of the outer ring and core.

According to an embodiment of the invention, the mechanical dimensions of the coins are determined by means of the signals of the sensor arrangement, in particular the width of the outer ring, the width of the central ring, the diameter of the core and the diameter of the coin.

The simplest optical arrangement for testing the three-part coins may consist of a single light path. According to an embodiment of the invention, it is preferred to move the coins through two optical paths which in each case have an optical transmitter and an optical sensor, wherein for example one path operates at wavelengths of the visible spectral range and the other path operates at wavelengths of the invisible spectral range. In a light source that transmits light both in the visible range and in the invisible range, for example, both optical sensors are activated when they receive the light. If the central ring is made of a material that is not transparent to invisible light, only one sensor of the two optical paths receives light when the central ring is moved through the two optical paths.

Alternatively, the sensor arrangement may be simultaneously sensitive to wavelengths in the visible and invisible range so as to activate the optical sensor in sequence in order to produce firstly light in the visible range and secondly light in the invisible range. To this end, two optical transmitters may be used according to an embodiment of the invention. Finally, it is also conceivable to operate the optical sensor temporarily in sequence to have different sensitivities, i.e., for defined wavelength ranges.

The invention is described in more detail hereinafter with reference to the drawings.

DETAILED DESCRIPTION

Figure 1A:
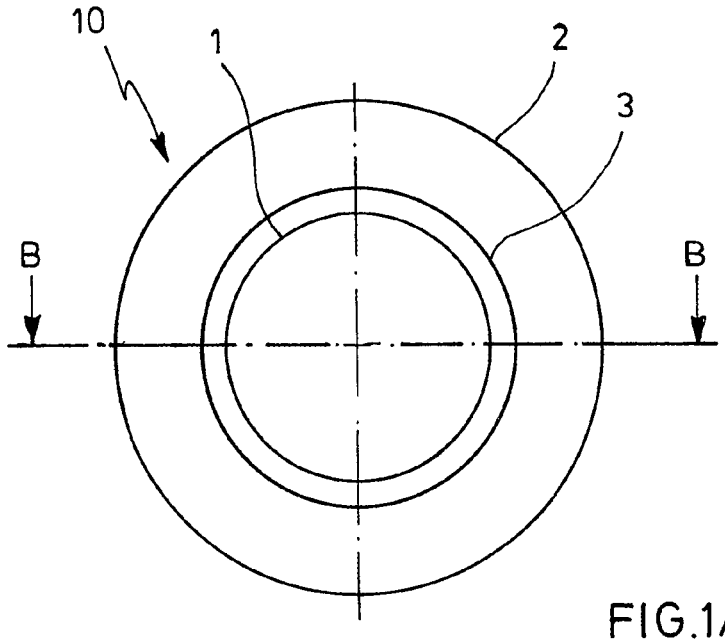
FIG. 1A shows a plan view of a coin made of three materials.
Figure 1B:
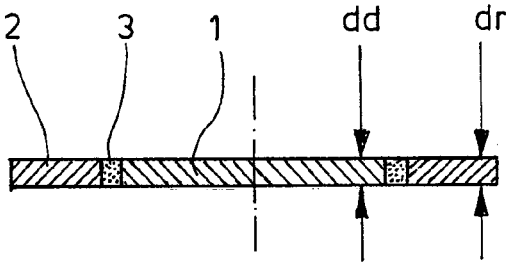
FIG. 1B shows a sectional view along line B-B in FIG. 1A.

Shown in FIGS. 1A and 1B is a coin 10 consisting of three parts, namely having a core 1 made of a first metal material, an outer ring 2 made of a second metal material and a central ring 3 made of an electrically insulating material, for example a polymer. Moreover, the material of the central ring 3 may be translucent or transparent. The thickness of the core 1 is indicated as dd and the thickness of the outer ring 2 is indicated as dr.

Figure 2:
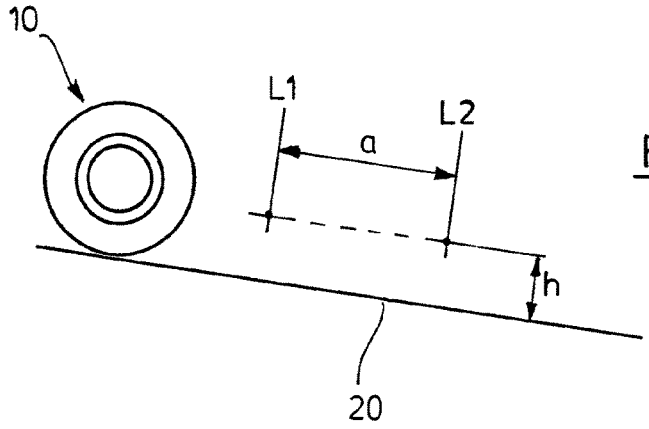
FIG. 2 shows a schematic view of the coin according to FIGS. 1A and 1B when passing through two light barriers L1 and L2.

Shown in FIG. 2 is a coin running track 20 along which the coin 10 rolls. Two light barriers L1 and L2 are arranged in the spacing a, said light barriers being at a height h above the coin running track 20. The light barriers consist, for example, of at least one optical transmitter and an optical receiver or sensor on different sides of the path of the coin 10. The light barrier L1 operates with light in the visible wavelength range and the light barrier 2 operates with light in the infrared wavelength range. When the coin 10 passes the light barriers L1 and L2, time recordings are made when the light barriers L1, L2 are interrupted. The interruption takes place for the first time when the edge of the coin 10 passes into the light barrier L1 and represents the time t0 in FIG. 3(*a*). At this time, both (transparent and non-transparent) wavelength ranges are blocked. However, if the edge of the transition from the metal outer ring 2 to the central ring 3 passes the light barrier L1, the transparent wave range is detected by the optical sensor of the light barrier L1, which is represented by the time t1. At the transition from the central ring 3 to the metal core 1, both wavelength ranges are blocked once again. This occurs at the time t2. When the second half of the coin 10 passes, the times t3, t4 and t5 are similarly determined. The individual ring widths or, respectively, the core diameter and the entire coin diameter may be detected from the determined time periods t0 to t1, t1 to t2, t2 to t3, t3 to t4 and t4 to t5. Such detections are described in DE 27 24 868, EP 0 839 364 and EP 0 694 888, for example. The determined individual ring widths may be used as security features.

Figure 3:
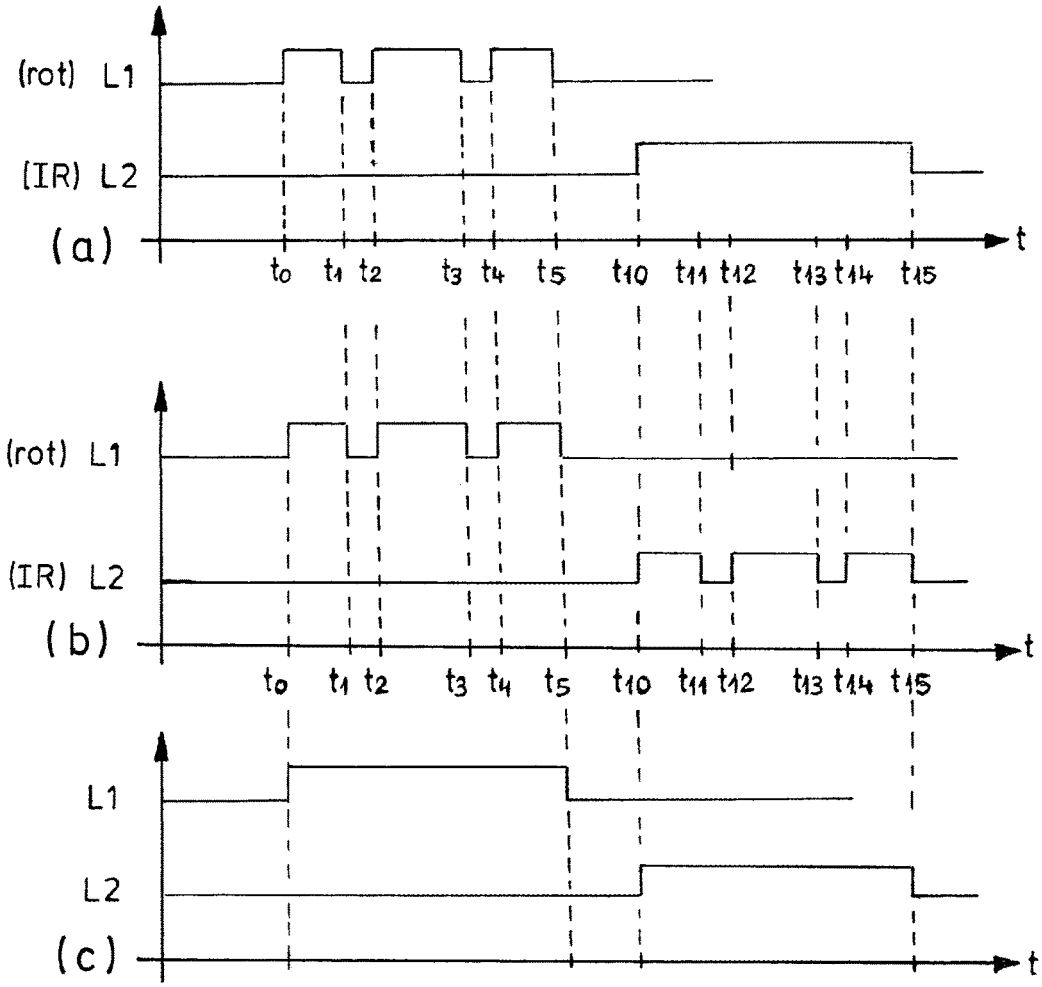
FIG. 3 shows the response of the light barriers to different materials of the central ring of the coins.

The light barrier L2 is positioned at the same distance from the track 20 as the light barrier L1 and the spacing a between L1 to L2 is known. From these preset measurements the mechanical spacings of the coins may be calculated. The light barrier L2 is designed for a specific wavelength range, for example infrared light. For this specific wavelength range, no changes to the signal are currently identified at t11 and t12, t13 and t14, but only at t15 if the entire coin 10 has passed the light barrier L2, as the material of the central ring does not allow the infrared light to pass. This is revealed from the graph of FIG. 3(*a*) at the bottom. FIG. 3(*b*) shows the process when a coin with a material of the central ring that is transparent to infrared light is tested. It may be seen that the same signal sequences are then produced for the light barriers L1 and L2. Thus, this is an effective discriminating feature for identifying coins provided with a counterfeit material for the central ring.

FIG. 3(*c*) shows the signal sequence for the two light barriers L1 and L2 both for a conventional bicolour coin and for coins provided with a central ring, where the material for the central ring is not transparent to both visible light and invisible light.

As a whole, the following security features are able to be identified:

Material of the central ring which is transparent to visible light;

Material where infrared light is blocked;

Widths of the outer ring to the left and right;

Width of the material of the central ring to the left and right; and

Core diameter.

Figure 4:
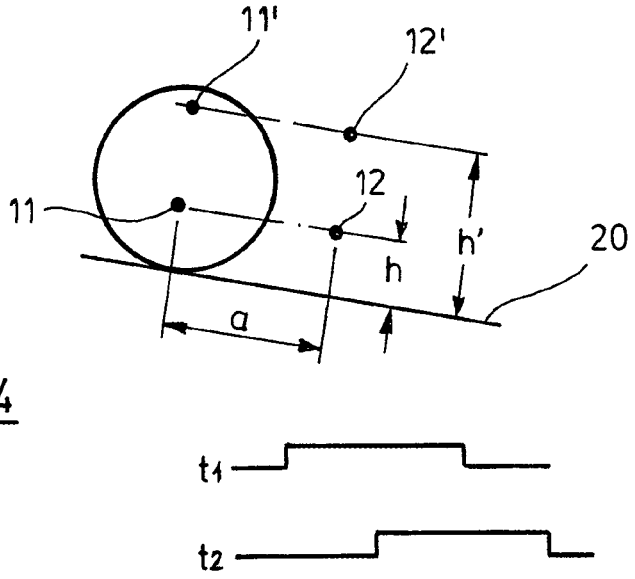
FIG. 4 shows a schematic view similar to FIG. 2 with two light barriers on top of one another.

In FIG. 4 four light barriers respectively consisting of one optical transmitter and one optical receiver which are identified by 11 and 12, or respectively 11' and 12', are arranged one above the other at a distance h, and respectively h', from the coin running track 20 and at a distance a from one another. If a standard coin of smaller diameter moves through the light barriers 11 and 12, a signal sequence t1 and t2 is produced. For a coin of larger diameter, similar signal sequences are also produced by the light paths 11' and 12'. However, if the light barriers are located level with a central ring according to FIG. 1A or 1B, similar signal sequences for 11 and 12 and 11' and 12' may be produced once again, as have been described in connection with FIG. 3.

Figure 5:
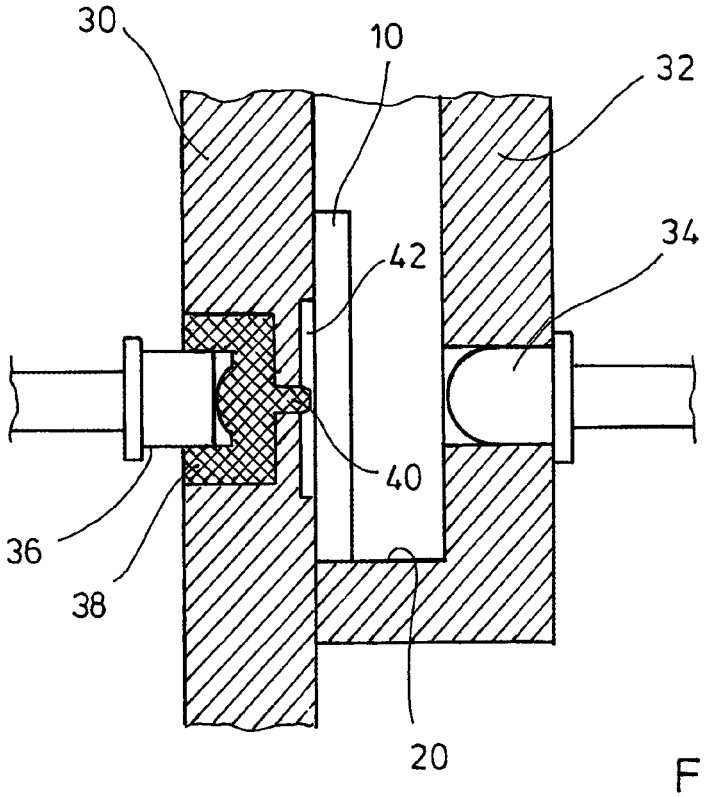
FIG. 5 shows a sectional view of an optical arrangement for carrying out a method according to the invention.

In FIG. 5 a principal plate 30 and a pivoting plate 32 are shown, wherein said pivoting plate 32 forms the coin running track 20. An LED 34 is incorporated in the pivoting plate 32, said LED 34 passing light through the coin 10 when it moves along the running track 20 past the LED 34. A phototransistor 36 is arranged in the principal plate 30, said phototransistor 36 cooperating with an optical element 38 that produces the effect of a lens and having a portion 40 with a small diameter protruding into a recess 42 of the principal plate 30. The optical element 38 receives the light produced by the LED 34 provided it is either not blocked by the coin 10 or is allowed through by a region of the coin 10 as is the case in connection with the above-described figures.

Figure 6:
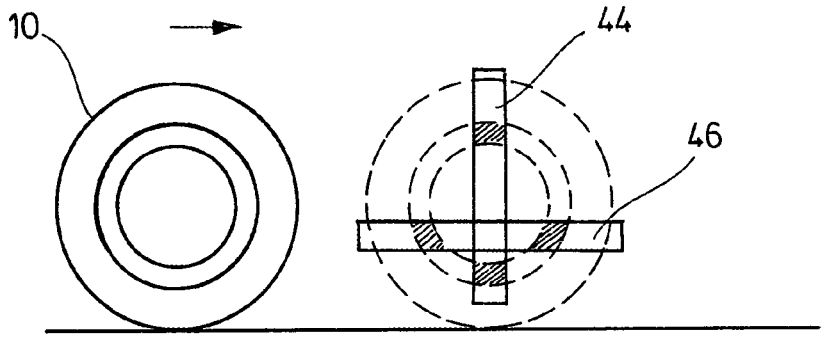
FIG. 6 shows a schematic view similar to FIG. 2 with a line detector or surface detector for the optical arrangement.
Figure 7:
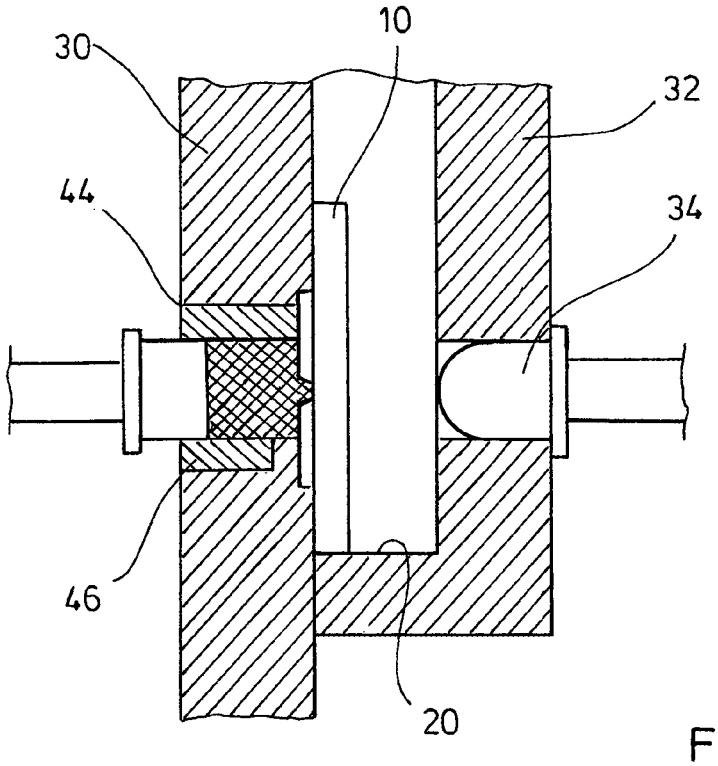
FIG. 7 shows a sectional view of the optical arrangement according to FIG. 6 for carrying out a method according to the invention.

Instead of a receiver at one point for the light of the LED 34, a line sensor or surface sensor may also be provided in a vertical and or horizontal arrangement as is shown by sensor 44 or respectively by sensor 46 in FIG. 6. In FIG. 7, the sensor 46 is shown in a horizontal arrangement through which light is passed by the LED 34 over the entire width of sensor 46 in order to receive light from the LED 34, which is either not blocked by the coin 10 or is allowed to pass therethrough.

The invention claimed is:

1. A method for testing a coin, comprising:

moving the coin through an optical arrangement and through light in a visible or an invisible range transmitted by at least one optical transmitter, wherein the coin has a core of a first metal, an outer ring of a second metal, and a central ring of electrically insulating material arranged between the core and the outer ring, and wherein the central ring is transparent to electromagnetic waves of a first wavelength range and less transparent or not transparent to a second wavelength range;

receiving by an optical sensor arrangement light passed through the central ring;

generating by an evaluator a signal when the coin is moved past the optical sensor arrangement, wherein the optical sensor arrangement is sensitive for both the first wavelength range and the second wavelength range, namely for light passed and light not passed or partially passed through the central ring; and generating by an evaluator a genuine coin signal when the optical sensor arrangement does not respond to light not passed or partially passed to the optical sensor arrangement.

2. The method according to of claim 1, further comprising:

analyzing by the evaluator the signal generated when the coin is moved past the optical sensor arrangement; and producing a genuine coin signal if a spectrum of the received light corresponds to the electrically insulating material of the central ring of a genuine coin.

3. The method of claim 1 wherein the optical sensor arrangement is sensitive to a wavelength range of visible light.

4. The method of claim 1 wherein the optical sensor arrangement is sensitive to a wavelength range of invisible light.

5. The method of claim 1 wherein the optical sensor arrangement is sensitive to electromagnetic waves in a wavelength range of visible light and electromagnetic waves in a wavelength range of invisible light.

6. The method of claim 5 wherein the optical sensor arrangement includes two sensors.

7. The method of claim 1 wherein the light is produced by an LED.

8. The method of claim 1 wherein the optical sensor arrangement includes a phototransistor.

9. The method of claim 1 wherein the optical sensor arrangement includes a surface sensor or line sensor.

10. The method of claim 1, further comprising determining mechanical dimensions of the coin by means of the signals of the optical sensor arrangement, the mechanical dimensions including a width of the outer ring, a width of the central ring, a diameter of the core and a diameter of the coin.

11. The method of claim 1, further comprising passing the coin through two optical paths which each include an optical transmitter and an optical sensor, wherein one path operates at wavelengths in a visible spectral range and the other path operates at wavelengths in an invisible spectral range.

12. The method of claim 1, further comprising:

activating temporarily an optical transmitter in sequence; and producing firstly light in a visible spectral range and secondly light in an invisible spectral range, wherein the optical sensor arrangement is sensitive to electromagnetic waves in a visible spectral range and electromagnetic waves in an invisible spectral range.

13. The method of claim 12 wherein the optical sensor arrangement includes two optical sensors of different sensitivities.

* * * * *